United States Patent [19]

Michelet

[11] 4,427,051

[45] Jan. 24, 1984

[54] TUBULAR ROLL FOR CONTINUOUS METAL CASTING MACHINES

[75] Inventor: Jacques Michelet, Metz, France

[73] Assignee: Institut de Recherches de la Siderurgie Francaise, Saint-German-En-Laye, France

[21] Appl. No.: 275,516

[22] Filed: Jun. 15, 1981

[30] Foreign Application Priority Data

Jun. 27, 1980 [FR] France ..... 80 14487

[51] Int. Cl.[3] ..... B22D 11/12

[52] U.S. Cl. ..... 164/448; 164/442; 29/116 R

[58] Field of Search ..... 164/499, 468, 484, 442, 164/448, 504, 507; 29/116 R

[56] References Cited

U.S. PATENT DOCUMENTS 3,882,923 5/1975 Alberny ..... 164/468

3,981,348 9/1976 Schmucker ..... 164/448

4,351,383 9/1982 Gladwin ..... 164/442

*Primary Examiner*—Gus T. Hampilos

*Assistant Examiner*—Richard K. Seidel

*Attorney, Agent, or Firm*—Michael J. Striker

[57] ABSTRACT

A roll for guiding a cast metal strand emanating from a continuous casting machine comprises a cylindrical envelop rotatable about its axis by contact with the cast metal strand. A pair of tubular spindles project from opposite ends of the envelop coaxially fixed thereto and rotably mounted in the region of the outer ends in ball bearings fixed to the machine frame. A central tubular arbor equiped in a central portion thereof with an inductor extends with radial clearance through the spindles and is supported at end portions thereof projecting beyond the spindles in cradles fixed to the machine frame. A key or the like is provided in one of the cradles engaging in a cutout of the central arbor to prevent rotation of the latter during rotation of the envelop and the spindles connected thereto.

7 Claims, 1 Drawing Figure

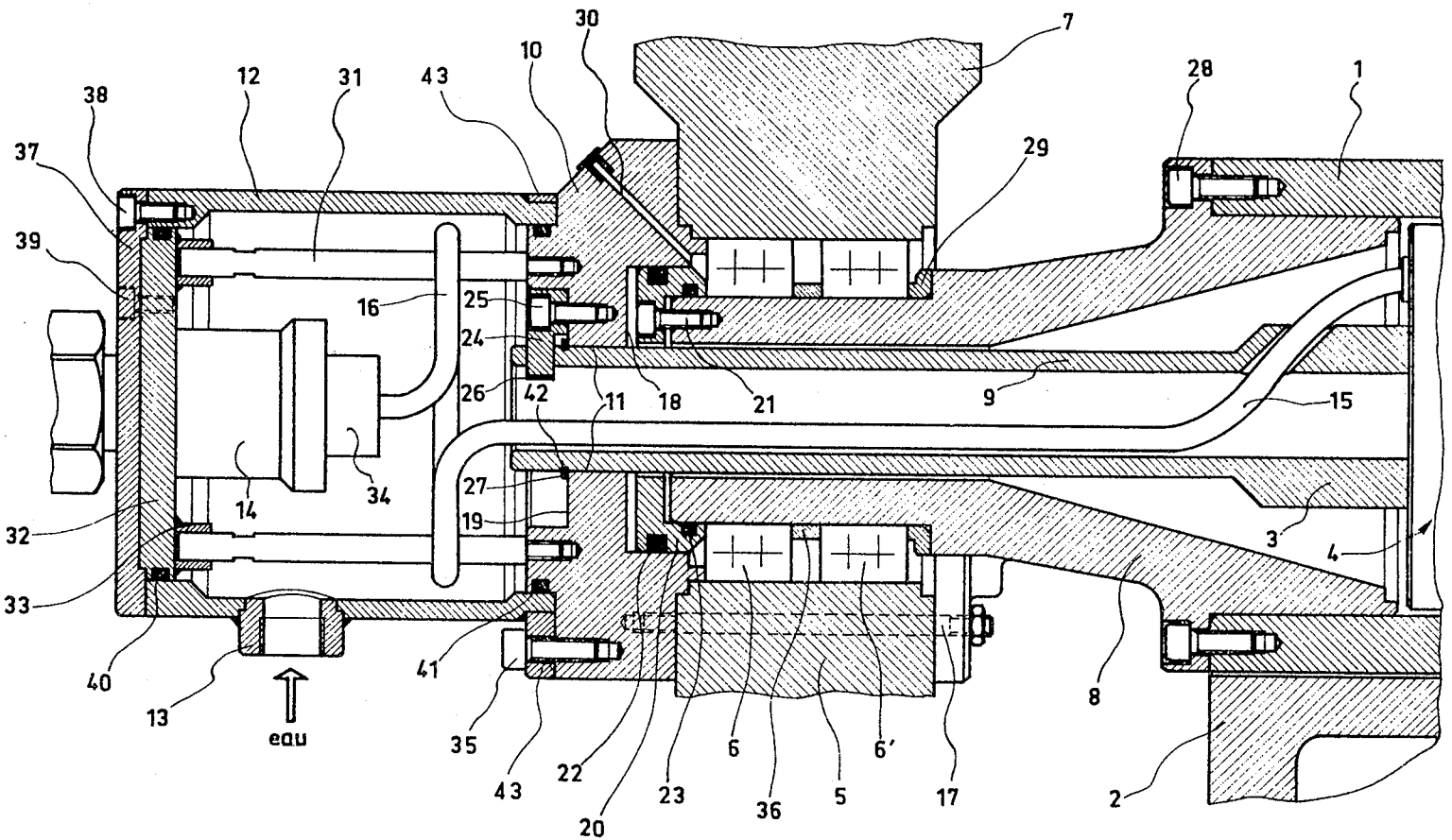
1
28
7
29
30
10
43
31
12
38
37
39
15
9
21
18
11
42
25
24
26
16
34
14
32
33
4
3
8
2
17
6'
5
36
6
23
20
22
43
35
41
27
19
13
40
eau

TUBULAR ROLL FOR CONTINUOUS METAL CASTING MACHINES

BACKGROUND OF THE INVENTION

The present invention relates to continuous metal casting, especially steel, and more specifically to rolls for supporting and guiding the cast product downstream of the ingot mold.

Rolls of this type have a cylindrical body rotatable about an axis extending normal to the direction of movement of the casting and are placed with one of their generatrices in contact with the cast product to be rotated about their axes. The rolls are rotatably supported by ball bearings fastened to the frame of the casting machine.

Usually, these rolls are solid, however tubular rolls are also known, the interior of which is used to receive functional elements, for instance a cooling system within an envelop in contact with the cast product (DOS No. 1,809,471), or an elastic suspension system which permits the envelop to follow the transverse variations of the cast product (DAS No. 1,082,377), or an electromagnetic inductor assuring a stirring of the still liquid core of the casting (British Pat. No. 1,405,312).

It is therefore necessary to provide a fixed orientation of such internal functional elements with respect to the cast product during rotation of the envelop. In this case the roll comprises a central arbor, correspondingly equipped, and being supported at opposite ends by bearing surfaces in support cradles and held against rotation by a key or other appropriate means. The envelop surrounds the arbor radially spaced therefrom and is mounted freely rotatable thereon by any adequate means, for instance ball bearings, permitting the desired Kinematic uncoupling.

This Kinematic independence of the interior of the roll with regard to its envelop provides for various essential advantages, such as the absence of rotating electrical contacts, as conduating rings with contact bushes, when an electromagnetic inductor is placed into the roll (British Pat. No. 1,405,312), or in this case, the possibility to provide for the latter a yoke for the return of the magnetic flux in order to avoid a dispersion of the magnetic energy outside of the region of the space occupied by the cast product, or the absence of turning hydraulic joints for the passage of cooling water for the inductor or the envelop itself (DOS No. 1,809,471).

SUMMARY OF THE INVENTION it is an object of the present invention to provide a tubular roll of the afore-mentioned kind which is improved over such rolls known in the art.

With these and other objects in view which will become apparent is the description proceeds, the tubular roll of the present invention for guiding a metal billet emanating from a continuous metal casting machine mainly comprises a central arbor, a cylindrical envelop surrounding a central portion of the arbor radially spaced therefrom and rotatable about its axis by contact with a metal billet emanating from the casting machine, a pair of tubular spindles coaxially fixed to opposite ends of the envelop, a pair of ball bearings mounted in the frame of the machine and rotatably supporting the spindles, and a pair of support cradles fixed to the machine frame. The central arbor has opposite cylindrical end portions which extend with radial clearance through the spindles beyond the latter and are supported in the cradles. The roll includes further, in one of the cradles, means, such as a key or the like, engaging the central arbor to prevent rotation thereof.

Each of the cradles is preferably provided at a side thereof facing the respective ball bearing with a cutout in which a member is located abutting against an end face of the respective ball bearing.

According to another feature of the invention the central arbor is of tubular construction to permit flow of cooling water through the interior of the roll and/or the passage of an elastic conductor, if the arbor is equipped with an electromagnetic inductor.

The basic idea of the present invention is therefore that, in contradistinction to the known solution, the central stationary arbor does not form a bearing rotatably supporting the envelop, but that the latter is at opposite end positions rotatably supported in standard bearings fixed to the machine frame, so as to be mechanically and functionally independent of the central arbor.

In addition to the above-mentioned advantages of tubular rolls, the present invention provides numerous specific advantages due to the mechanical autonomy of the envelop from the central arbor and the manner in which this autonomy is obtained.

Thus, no mechanical stresses will be transmitted to the central arbor from the envelop, while the latter is subjected to unavoidable deformations due to the characteristics of the cast product with which it is in contact (variations of the geometric profile of the product, swelling of the faces due to ferrostatic pressure, especially perceptible at products of large cross-section, such as slabs, etc.) From this results a greater flexibility in the choice of functional elements with which the central arbor can be equipped, especially in the case of an electromagnetic inductor.

Another advantage resides in the possibility, or, at least, the facility with which it is possible to render the roll active for extraction of the cast product. This can be realized in a simple manner by coupling a motor to an accessible part of the spindle between the envelop and a corresponding bearing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single drawing is an axial cross-section through half of a tubular roll of the present invention for a machine for continuous casting of steel slabs.

DESCRIPTION OF A PREFERRED EMBODIMENT

Referring now to the drawing, it will be seen that the roll of the present invention comprises a cylindrical envelop 1, in contact with one of its generatrices with a large face of a slab or billet 2 emanating during its solidification from a continuous metal casting machine, not shown in the drawing. A pair of tubular spindles 8, of which only one is shown in the drawing, project from opposite ends of the envelops 1 coaxially fixed thereto and the outer end of each spindle 8 is supported in a bearing 5 having balls 6, 6', which, in turn is mounted in a frame 7 of the machine opposite the billet 2. A central tubular arbor 3, provided at a central portion thereof with an electromagnetic inductor, partially shown at 4, extends with radial clearance through the envelop 1 and the tubular spindles 8. The cylindrical end portions 9 of the arbor 3 projecting beyond the respective spindle 8 are respectively supported in bores 11 of cradles 10, of which only one is shown in the drawing, which, in turn, are mounted on the side of the machine frame 7 facing away from the billet 2.

A casing 12 is connected to the cradle 10 at the side thereof facing away from the frame 7. The casing 12 is provided with an opening 13 for the passage of cooling water. An electrical connection box 14 is located in the casing 12 connected by an electrical conductor 15, forming in the casing 12 a loop 16, with the inductor 4.

The cradle 10, constituted by an annular member, is connected to an end face of the ball bearing 5 by means of bolts 17 extending through the beaing. The cradle 10 is provided with central cutouts 18 and 19 respectively extending from opposite faces of the cradle into the latter. An annular block 20 is located in the cutout 18 holding the balls of the ball bearing 5 in place. The block 20, connected by screws 21 to the end of the spindle 8 rotate therefore with the latter and carries two annular seals, i.e., a seal 22 located in a groove on the outer peripheral surface of the block 20 and bearing with sealing lips against the peripheral surface of the cutout 18, and a standard toric seal 23 bearing against the outer peripheral surface of the spindle 8. A key 24 connected to the cradle 10 by a screw 25 is located in the cutout 19 and serves to hold the central arbor 3 against rotation. The Key 24 is in the form of a sector which penetrates into a notch 26 machined longitudinally from an end face into an end portion 9 of the central arbor 3. This end portion 9 is further provided, within the cutout 19, with an annular groove 42 in which a circlip 27 is arranged, which, abutting against the cradle 10 prevents longitudinal movement of the arbor 3 from the left to the right, as viewed in the drawing, whereas movement in the opposite direction is prevented by the Key 24.

The roll of the present invention is assembled as follows.

After the arbor 3 equipped with the inductor 4 is inserted into the envelop 1, the spindle 8 is slipped over the end portion 9' of the arbor and fixed to the envelop 1 by screws 28. The free end-portion of the spindle 8 is then introduced into the bearing 5 until it abuts against a ring 29 placed against a shoulder of the spindle.

The ball bearing 5 has two groups of balls 6, 6' separated by a spacer 36. The annular block 20 is then fixed by screws 21 to the free end of the spindle 8 so as to hold the two groups of balls in place.

Subsequently thereto the cradle 10, provided with a channel 30 for lubricating the groups of balls 6, 6' is slipped over the outer end of the arbor 3 and fastened to the bearing 5 by bolts 17. The circlip 27 is then placed into the grooves 42, the Key 24 is axially inserted into the slot 26, and the support rods 31, about which the loop 16 is formed, are fastened to the cradle 10. A support plate 32 for the connection box 14 is then connected by the hollow plugs 33 to the outer ends of the rods 31 and the conductor 16 is connected to the box 14 by a plug 34. The casing 12 is then pushed in longitudinal direction against the outer end face of the cradle 10 and fastened to the latter by screws 35 extending through a circular flange 43 soldered to the casing 12 whereafter the assembly is completed by fastening a closure plate 37 by screws 38 to the casing 12 and to the support plate 32 by screws 39. Annular seals 40 and 41 provided at opposite ends of the casing 12 will assure its fluid tightness.

It is to be understood that the other half of the roll, not shown in the drawing differs only from the above description in that neither a Key 24 nor a circlip 27 is provided therein in order to permit the free longitudinal expansion of the arbor 3.

However, it is advantageous to provide therein also a slot 26 and a groove 42 in order to permit reversibility of the roll.

Furthermore, it is emphasized that a portion of the spindle 8 between the envelop 1 and the bearing 5 may be constructed for coupling a drive motor to the roll.

It will be understood that each of the elements described above, or two or more together, may also find a useful application in other types of tubular rolls differing from the types described above.

While the invention has been illustrated and described as embodied in a tubular roll for guiding a metal strand emanating from a continuous casting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with a continuous metal casting machine having a frame, a tubular roll for guiding a continuous metal billet emanating from said machine comprising a central arbor; a cylindrical envelop surrounding a central portion of said arbor radially spaced therefrom and rotatable about its axis by contact with a billet emanating from the machine; a pair of tubular spindles respectively fixed to opposite ends of said envelop coaxial therewith; a pair of ball bearings mounted in the machine frame and rotatably supporting said spindles; a pair of support cradles fixedly connected to the machine frame, said central arbor having a pair of opposite tubular end portions extending with radial clearance through said spindles and projecting beyond the latter to be supported by said cradles; means in one of said cradles for preventing rotation of said central arbor; and an electromagnetic polyphase inductor arranged in said envelope on the central portion of said arbor to produce magnetic stirring in the billet when activated.

2. A tubular roll as defined in claim 1, and including a casing secured to one of said cradles, an electrical connection box in said casing and a conductor leading from said connection box through a corresponding tubular end position of said central arbor to said inductor.

3. A tubular roll as defined in claim 2, said casing including means for passing a cooling liquid through the tubular end portion of said central arbor to said inductor.

4. In combination with a continuous metal casting machine having a frame, a tubular roll for guiding a continuous metal billet emanating from said machine comprising a central arbor; a cylindrical envelop surrounding a central portion of said arbor radially spaced therefrom and rotatable about its axis by contact with a billet emanating from the machine; a pair of tubular spindles respectively fixed to opposite ends of said envelop coaxial therewith; a pair of ball bearings mounted in the machine frame and rotatably supporting said spindles; a pair of support cradles fixedly connected to the machine frame, said central arbor having a pair of opposite cylindrical end portions extending with radial clearance through said spindles and projecting beyond the latter to be supported by said cradles; and means in one of said cradles for preventing rotation of said central arbor.

5. A tubular roll as defined in claim 4, wherein each of said cradles is provided at a side thereof facing the respective ball bearing with a cutout and including an annular member in said cutout and abutting against an end face of the respective ball bearing.

6. A tubular roll as defined in claim 4, wherein said central arbor is tubular.

7. A tubular roll as defined in claim 4, wherein said means for preventing rotation of said central arbor are provided only in one of said cradles.

* * * * *